US010607433B2

(12) United States Patent
Danson

(10) Patent No.: US 10,607,433 B2
(45) Date of Patent: Mar. 31, 2020

(54) DUAL ACCESS RIDE LOCKERS

(71) Applicant: VLocker PTY, LTD, Loganholme DC (AU)

(72) Inventor: Alan Maurice Danson, Loganholme (AU)

(73) Assignee: VLocker PTY LTD, Loganholme DC, QL (AU)

( * ) Notice: Subject to any disclaimer, the term of this patent is extended or adjusted under 35 U.S.C. 154(b) by 0 days.

(21) Appl. No.: 16/191,420

(22) Filed: Nov. 14, 2018

(65) Prior Publication Data

US 2019/0147681 A1 May 16, 2019

Related U.S. Application Data

(60) Provisional application No. 62/585,547, filed on Nov. 14, 2017.

(51) Int. Cl.
*G07C 9/00* (2020.01)
*A47B 61/04* (2006.01)

(52) U.S. Cl.
CPC ..... *G07C 9/00571* (2013.01); *A47B 61/04* (2013.01); *G07C 9/00912* (2013.01); *G07C 9/00563* (2013.01)

(58) Field of Classification Search
CPC ..... G07C 9/00896; G07C 9/00309; G07C 9/00571; G07C 9/00912; G07C 9/00111; G07C 2009/00793; G07C 2009/00936; G07C 9/00103
USPC ..... 340/5.73
See application file for complete search history.

(56) References Cited

U.S. PATENT DOCUMENTS 4,836,352 A * 6/1989 Tateno ..... G07F 17/12 177/25.15
5,820,018 A * 10/1998 Stacy ..... A47G 29/16 232/24
2014/0316918 A1* 10/2014 Zaniker ..... G06Q 30/0645 705/21
2016/0133075 A1* 5/2016 Amdahl ..... G07C 9/00912 340/5.51
2019/0135362 A1* 5/2019 Fournier ..... B62H 5/003

* cited by examiner

*Primary Examiner* — Mark S Blouin
(74) *Attorney, Agent, or Firm* — Kyle W. Rost

(57) ABSTRACT

A queuing structure leading to an event of short-term duration is formed, at least in part, by a bank of dual access lockers with one face accessible to guests on an ingress path within the queuing structure. The second and opposite face of the dual access lockers is accessible to guests on an egress path leading from an exit from the short-term event. The bank of lockers defines a wall that separates the ingress and egress paths serviced by the dual access lockers. An electronic controller identifies each guest and opens an ingress side door of an assigned locker at the ingress side of the locker bank, and again identifies the guest and opens an egress side door of the assigned locker at the egress side of the locker bank.

10 Claims, 2 Drawing Sheets

DUAL ACCESS RIDE LOCKERS

BACKGROUND OF THE INVENTION

Field of the Invention

The invention generally relates to supports and cabinet structure. More specifically, the invention relates to cabinet structure that is accessible from plural sides, and still more specifically to cabinet structure that alternatively is accessible through opposite sides. In another respect, the invention generally relates to cabinets or racks specially adapted for other particular purposes.

Description of Related Art

Lockers can be found in many public facilities, especially in staging areas such as waiting rooms and pre-queuing zones outside an entrance queue area where a target event activity takes place. In these and other usage areas, the newly arriving user has the opportunity to store his property in a locker while he attends the target event or activity. After the user has completed the event or activity, as an exiting user, he returns to the locker area to obtain his property. Thus, lockers conventionally serve users in an outer zone separated from defined entrance queue and exit routes.

Single door lockers are typically chosen for use in staging and waiting areas. The user typically is familiar with single door lockers and, in some instances, might even use his own padlock on the locker door. A disadvantage of using single door lockers is that the exiting user must return to the original staging area in order to recover his property from the locker. Having both arriving users and departing users in the same area can result in congestion and require inefficient design of the facility. The facility must be structured to allow both arriving and departing users to access the same locker area, effectively doubling the required user capacity at the locker area.

Having such large foot traffic capacity dictates that the lockers must be located far from the target event or activity. This far distance translates into increased usage time of the lockers. As each locker is in use for a longer time, the facility must maintain a larger number of lockers so that arriving users can be accommodated. Thus, there is a corresponding increased cost to locating locker areas far from the target event or activity, particularly when the event or activity takes place with ongoing cycles such that ingress and egress are continuous or repeated with high frequency.

Various dual door passage systems are known in which an article is placed in secure chamber from a first side and is removed from a second and opposite side. An example is a chamber between a sanitized environment or "clean room" and the outside world, allowing transfer of objects into the clean room without introducing contaminants to the room. Locks on the doors at opposite sides of the chamber are coordinated to prevent both from being open at the same time.

A coordinated system for operating the opposite doors of such a secure chamber or locker is a practical requirement. Within a confined environment such as a workplace where trained employees are the ones operating the door system, or where a trained operator can control both doors, a two door locker can be used effectively.

However, there are situations where dual door secure lockers have not been practical or effective. An example of this latter situation is where the user is unfamiliar with the technology of the dual door secure locker, but this same user will be required to interface with and operate both doors of the locker at different times, such as to place his property into the locker through a first of the opposite doors and to withdraw his property from the locker through the second of the opposite doors. Where the locker is to be secure, both doors must have locking capability. Yet, the user cannot practically apply his own lock, such as a padlock, to the first door because he will be using the other door to withdraw his property. The problem is increasingly complex when the user has only infrequent contact with the dual door system, such that he has little or no training or retained knowledge of the door operating system. Where the secure locker is operated in a busy location, an added problem is that the user has no privacy. Any bystander can see and hear whatever instructions are available to the user. For these and additional reasons, maintaining a secure, dual door locker in an area with high foot traffic can be especially impractical and ineffective.

It would be desirable to provide a dual access locker with reliable security and reliable operation to even an inexperienced, infrequent user.

Additionally, it would be desirable to provide a locker system that operates in an area of high foot traffic, which expedites usage both by the arriving user placing his property into a locker and by the departing user withdrawing his property from a locker.

Further, it would be desirable to create and operate queuing structures with guest lockers located within a zone of separate ingress and egress routes and simultaneously serving guests in both without intermingling.

Another desirable goal is to enable creation of an efficiently sized and structured integration of guest lockers in a queuing structure with the lockers near the activity served by the queuing structure rather than in a pre-queuing structure zone.

To achieve the foregoing and other objects and in accordance with the purpose of the present invention, as embodied and broadly described herein, the method and apparatus of this invention may comprise the following.

BRIEF SUMMARY OF THE INVENTION

Against the described background, it is therefore a general object of the invention to provide improved queuing structures with divided ingress and egress routes serviced by dual access lockers.

The accompanying drawings, which are incorporated in and form a part of the specification, illustrate preferred embodiments of the present invention, and together with the description, serve to explain the principles of the invention. In the drawings:

DETAILED DESCRIPTION OF THE INVENTION

The invention is directed to dual access ride lockers in an environment of a queuing structure. In its preferred embodiment, the invention is a specific solution to solve the problem of providing guests with short-term locker space while riding amusement rides. Lockers are especially needed at amusement parks because guests frequently carry personal property with them. Almost any hand-carried personal property is difficult to carry on the rides. Beyond such ordinary difficulty of the property being a burden, personal property can be damaged or become a hazard on rides involving spinning, inversion, turning, or substantially any other generation of forces. The amusement park likely bans the guests from carrying any object on force-generating rides, because the carried objects can break away from the owner' control and be lost or become hazards to others. Some typical examples of carried objects that may be banned from an amusement park ride include cameras, telephones, prizes, food packages, purses, key rings, knapsacks, hats, and spare clothing.

An amusement park ride needs lockers for frequent short-term use and turnaround to the next user. Guests enjoy an amusement park by moving from ride-to-ride as they travel through the park. Using a new locker at each ride allows the guest to keep his personal property at hand throughout his visit to the park, rather than having to return to an earlier location that, by the later time, might be far away. With ordinary, single door lockers, the stream of arriving guests can deposit their property in a locker before a ride; and after the ride, they must return to the same locker location to use the same single door to retrieve their property. Both arriving and departing guests use the same locker area, which requires sufficient space for both streams of guests to be accommodated. Where a locker area is located near each ride, the size of the locker area dictates that the area must be remote from the ride, in a pre-queuing area. As the locker area is located increasingly far from the ride, the timing cycle of each use is increased. In turn, the locker area must be further increased in size and equipped with an increased number of lockers so that empty lockers are available to all arriving guests.

Figure 1:
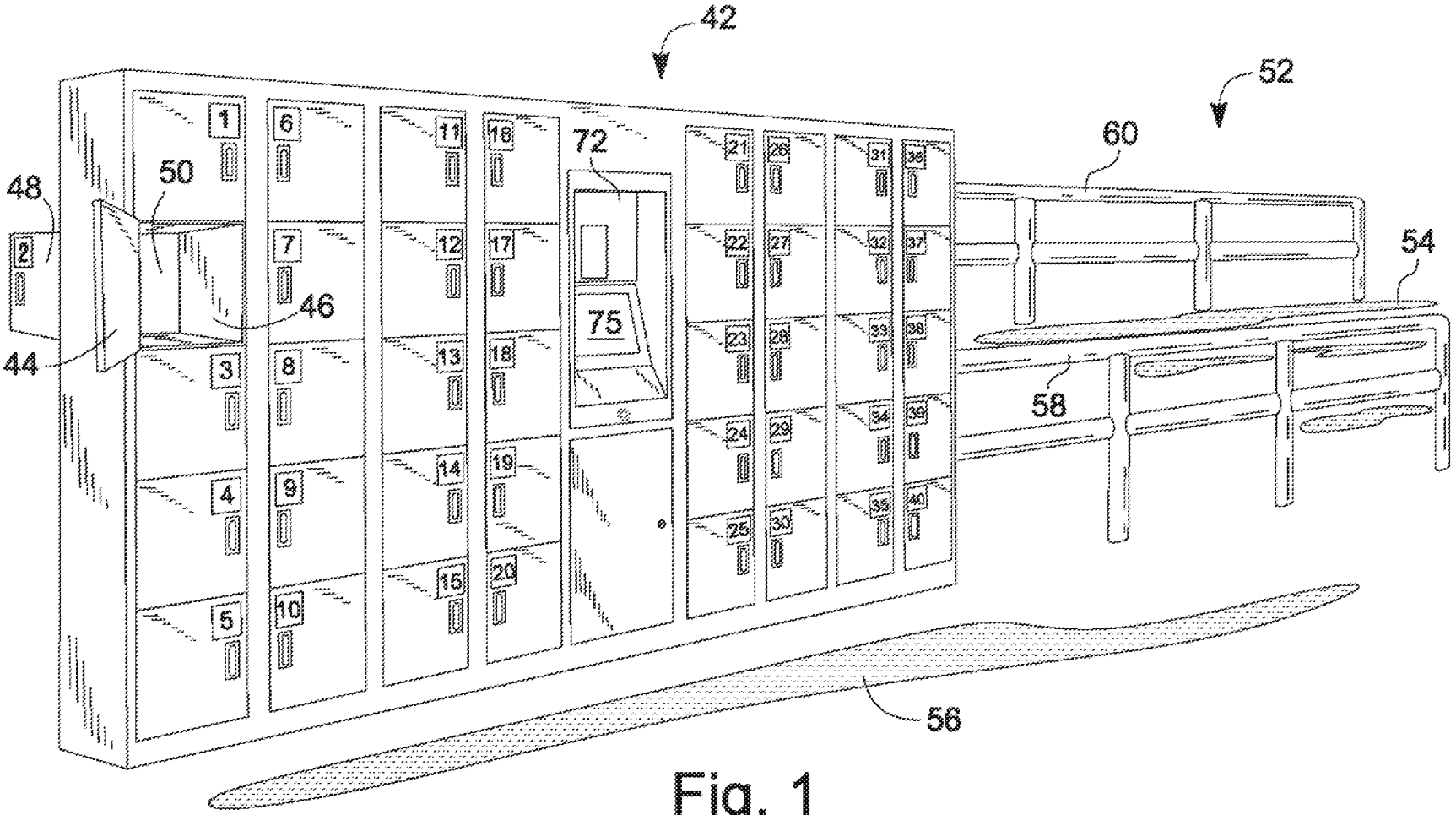
FIG. 1 is a perspective view of a bank of dual access lockers positioned within a queuing system, showing both doors of a locker in open position to show through passage between the opposite doors, as well as through passage between a queuing side and an opposite returning side of the locker bank.

With reference to FIG. 1 of the drawings, a significant improvement in structure and operation of queuing a arrangements is made possible by use of one or more banks of dual access lockers 42. The key feature of a dual access locker is that the individual locker alternatively is accessible through opposite sides. In the illustrated bank of lockers 42, there are forty individually identified lockers, such as numbered lockers 1-40. The locker numbered 2 is shown to have two doors on opposite faces, representative of similar doors on all other of lockers 1-40. On the front face of bank 42 from the view in FIG. 1, a front face door 44 is open, revealing the interior 46 of the locker 2. On the rear face of locker 2, an opposite rear face door 48 is open. With both doors 44 and 48 in open positions, the locker is shown as a through passage, with a visible open rear face 50. All of the forty lockers in the bank 42 may be similarly structured to have both a front face door and a rear face door.

The illustration of locker number 2 with both front face door 44 and rear face door 48 simultaneously in open position is for the limited purpose of description. In normal operation, the two doors are managed by means that allow one door at a time to be open. Further, the management of door opening may be by electronic or computerized controllers that identify a guest, assign a locker, and maintain the identity through one cycle of use. The identified guest is entitled to control both doors of the assigned locker, in contrast to other types of locker arrangement wherein different users are identified or entitled to operate one or the other of the two doors. This sameness in the entitled access through of both doors creates a secure locker for the entitled user during one cycle of use.

The bank of lockers 42 is located with one face accessed from a queuing structure 52. Conventionally, the queuing structure is for guiding and containing a line of people waiting for something, such as an amusement ride. In general, queuing structures are used in connection with entrance to many types of facilities such as sports stadiums or theaters. The best presently anticipated use of the invention is with a continuous or short-term cyclic event, where arrival and departure of guests is on a fairly continuous basis. The queuing structure 52 is representative of queues used at an amusement park ride. The bank of lockers 42 is arranged within the queuing structure 52 such that one face of the bank 42 is toward the ingress path 54 for guests arriving at ride and entering the queuing structure. The opposite face of the bank 42 is toward the egress path 56 for guests exiting from the ride, which, rather than a queue, simply may be an exit passage from a protective barrier surrounding the ride.

A side rail 58 of the queuing structure is combined with the locker bank 42 so that, together and optionally as a continuation of one another, the two components form part of a guide or containment for guests moving toward the ride. Another side rail 60 is spaced from rail 58 and locker bank 42 to define an opposite member of a pair of guides on opposite sides of pathway 54 leading toward the ride. In the orientation of FIG. 1, the rear face of locker bank 42 is open to the guests on pathway 54. Guests wishing to deposit their property in lockers 1-40 have access through the ingress face doors 48 from within the queue.

The opposite or front face of the locker bank 42 faces egress pathway 56, exiting from the ride. The exiting guests are exposed to the exit or egress side of the locker bank 42 from the exit pathway. The exit side may display individual locker identification that is the same as encountered on the opposite, ingress side. Here the guest can withdraw his property from the previously used locker via an egress side door 44, which opens to the same locker area 46 as the guest previously used to deposit his property. The locker bank 42 separates the egress pathway 56 from the ingress pathway 54. The guest can access his locker from either side, eliminating the need to return to the side of original access when he wishes to withdraw his property.

Figure 2:
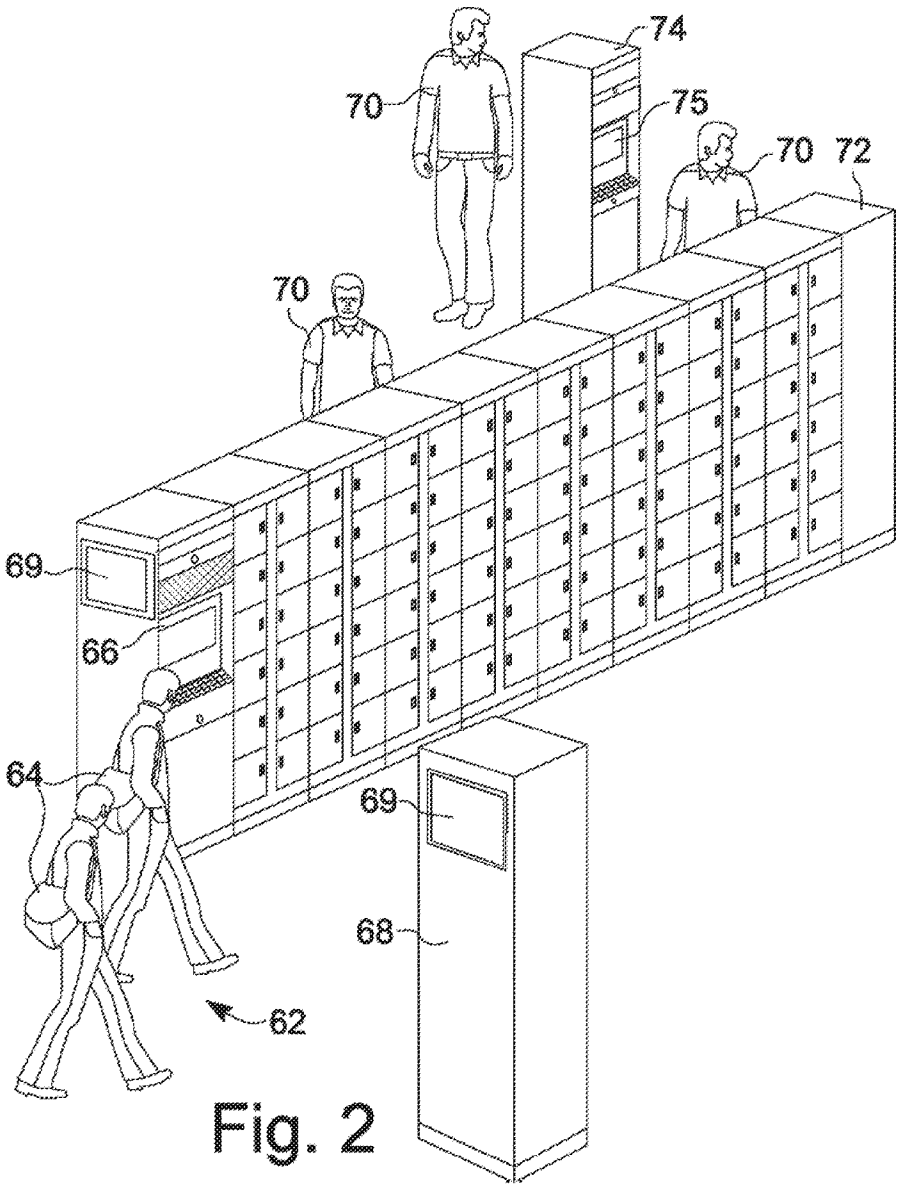
FIG. 2 is a isometric view of a bank of dual access lockers, with terminals and kiosks providing information and instruction, and with separate foot traffic on opposite face of the locker bank.

With reference to FIG. 2 of the drawings, the lockers of a locker bank 42 at an amusement park are individually used in ride cycles. The locker bank can be accessed by multiple guests on both the ingress side and egress side at the same time, in FIG. 2, the face of the drawing shows the ingress side of the locker bank 42. One or more arriving guests 62 may arrive carrying personal property such as satchels 64 that must be stored before the guest reaches the ride. At the locker bank, locker controllers provide a management interface that is accessed through access terminals 66 or similarly purposed kiosks 68. The locker controllers provide rapid allocation of lockers by use of the latest PIN codes. These access terminals provide large video touch screens and display screens 69 to provide instructions and direction regarding ride locker use.

At the ride entrance, a guest clicks on a touchscreen as instructed by a visual demonstration on an access terminal screen 69. The guest enters an identifying detail such as a date of birth and favorite color. The controller assigns a locker number, and the number is displayed on the screen. The controller also electronically opens the ingress side door of the assigned locker.

Optionally, the controllers provide Input devices to receive still other guest input, take readings of a biometric feature, or otherwise establish another repeatable identity factor of the guest. Some of the possible tools for identifying the guest are keyboard, camera, scanner, microphone, lights, sounds, established codes, and dispensed tokens or tickets. Further, access and communication with the controller may employ smartphones. Biometric devices include a security identification and authentication device. Such devices use automated methods of verifying or recognizing the identity of a living person based on a physiological or behavioral characteristic. These characteristics include fingerprints, facial images, iris prints and voice recognition. In addition to determining an identity factor related to the arriving guest 62, the terminals are interfaced with the lockers to rapidly assign a locker and speed the guest onward, as described above.

On the rear side of the locker bank as shown in FIG. 2, exiting guests 70 are leaving the ride and picking up their personal property from the lockers. These exiting guests 70 previously obtained lockers as described in connection with the arriving guests 62. The egress pathway leads to the egress side of the locker bank, where exit side access terminals 72 and exit side kiosks 74 use similar touch screens 75 or other optional tools described above. The guest clicks on a touchscreen 75 as instructed by an exit side access terminal 72, 74 and is guided through remaining steps. Once the controller has re-established the guest's identity factor at the exit side, the controller reminds the exiting guest which locker is his by displaying the locker number of the screen 75. The controller then electronically unlocks the egress side door of the guest's locker. The guest 70 can remove his property 64 from the locker. The egress side locker door is locked when the guest has finished, completing one cycle of locker use. Built-in safeguards prevent the locker from being allocated if the door is still open on the exit side.

Locating a bank of dual access lockers in the entrance queue enables the lockers to be positioned as close to the ride embarkation as possible. As a result, the number of lockers required only has to cater to a small number of ride cycles. The bank of lockers forms a wall that is positioned between the ride entrance and ride exit. The wall of lockers allows access from one side when entering the ride and from the other side when exiting the ride. Entrance and exit areas are completely separated by the locker wall.

Lockers have dual doors and multiple locker controllers on both entrance and exit sides. The controllers may use the latest PIN codes to provide secure and extremely rapid allocation of lockers. Large video display screens can provide instructions and directions regarding locker use.

Resulting benefits are that fewer lockers are required, leading to less capital outlay. Correspondingly, less space is required. The associated savings may allow the locker facility to operate without charging guests for this service. In addition, the computerized controllers allocate lockers quite rapidly. The placement of lockers in the queue has the further advantage of allowing guests to keep smartphones and cameras with them for most of their queuing time. This provides guests with more distractions and activities while queuing.

In addition to the advantages for guests and amusement park operators, the invention solves issues facing ride designers, as well. The locker bank can be integrated into a pre-existing queuing structure for an established ride, where room for a preliminary locker area is not available. This ability is particularly valuable where there is mandatory requirement to provide ride lockers on inverted rides. Further, the overall efficiency of the invention may satisfy the guests' expectation that they should not have to pay for a ride locker. A further efficiency is in the reduction in the number of ride lockers required. A large number of ride lockers is needed in the conventional arrangement placing ride lockers before a queuing area. This conventional placement increases the number of lockers required to cater to the maximum number of guests queuing for a ride. Prior lockers are objectionable for the additional reason that they must be keyless. Electronic and paypoint kiosks are required. These many issues surrounding prior locker arrangements lead to the need for a large capital outlay and a large amount of space required.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

What is claimed is:

1. A structure of a plurality of dual access ride lockers, comprising:

a bank of said lockers, wherein said bank of lockers has oppositely directed first and second outward faces;

the lockers of the bank have oppositely directed first and second doors whereby an individual locker of the bank of lockers is alternatively accessible through said oppositely directed doors, the first door facing outward from said first face of the bank of lockers and the second door facing outward from the second face of the bank of lockers, whereby, in use, the bank of lockers is locatable between a tide arrival side path and a ride departure side path with the first face of the bank of lockers accessible from the arrival side path and the second face of the bank of lockers accessible from the departure side path, and the lockers are individually accessible through their respective first doors from the arrival side path and are individually accessible through their respective second doors from the departure side path; and a locker door management system structured to monitor available lockers of the bank of lockers, to receive input of an identification factor for a prospective user of a locker of the bank of lockers, to choose and assign an available locker to said prospective user, converting e prospective user to an existing user, and to entitle said existing user to access said assigned locker of the bank of lockers through the first door and the second door of the assigned locker.

2. The structure of a plurality of dual access ride lockers of claim 1, wherein said locker door management system further comprises:

a first user access terminal located proximate to said first face of the bank of lockers, adapted to identify said assigned locker to said existing user and to enable access to the assigned locker by opening said first door of the assigned locker.

3. The structure of a plurality of dual access ride lockers of claim 1, wherein said locker door management system further comprises:

a second user access terminal located proximate to said second face of the bank of lockers, adapted to receive a known identification factor for an existing user having a previously assigned locker, to re-identify said previously assigned locker, and to enable access to the previously assigned locker by unlocking said second door of the previously assigned locker.

4. The structure of a plurality of dual access ride lockers of claim 1, wherein said locker door management system further comprises:

an electronic controller communicating with first and second user access terminals to monitor availability of individual lockers, identify an existing user, and control access to said assigned locker by said existing user;

wherein, said first user access terminal is located proximate to said first face of the bank of lockers and is adapted to identify said assigned locker to said existing user and to enable access to the assigned locker by opening said first door of the assigned locker; and said second user access terminal is located proximate to said second face of the bank of lockers, is adapted to receive a known identification factor for an existing user having a previously assigned locker, to re-identify said previously assigned locker, and to enable access to the previously assigned locker by unlocking said second door of the previously assigned locker.

5. The structure of a plurality of dual access ride lockers of claim 1, wherein:

said locker management system is structured to assign an available locker to an existing user and to entitle said existing user to control both doors of the assigned locker through one cycle of use, wherein a cycle of use is one opening of the first door and one opening of the second door of the assigned locker.

6. The structure of a plurality of dual access ride lockers of claim 5 wherein:

a cycle of use of said assigned locker with respect to door openings is limited to allowing one door at a time to be open.

7. The structure of a plurality of dual access ride lockers of claim 1, further comprising:

a side rail positioned at a longitudinal end of said locker bank, whereby, the locker bank is deployable with the side rail defining an extension from the end of the locker bank, together positionable, in use, to form a dividing guide between said ride arrival side path and said ride departure side path, with the bank of lockers and the side rail located between a ride arrival side path and a ride departure side path with the first face of the bank accessible to users on the arrival side path and the second face of the bank accessible to users on the departure side path.

8. A bank of dual access ride lockers, comprising:

first and second faces of said bank arranged in opposition to one another;

a plurality of individual ride lockers each having first and second doors positioned in opposition to one another;

said lockers being arranged in a grouping wherein said first doors face outwardly from said first face of the bank and said second doors face outwardly from said second face of the bank;

first and second terminals and a controller, in use the first and second terminals receiving inputs from a customer regarding access to a specific one of the lockers, wherein said first terminal is located proximate to said first face of the bank and is connected to said controller to authorize customer access to the first door of said specific locker; and said second terminal is located proximate to said second face of the bank and is connected to said controller to authorize customer access to the second door of the specific locker; and wherein the controller is structured to electronically open the first door of the specified locker in conjunction with authorizing customer access to the first door.

9. The bank of dual access ride lockers of claim 8, wherein said first terminal is located at a first end of said bank; and said second terminal is located at a second and opposite end of the bank;

whereby said bank is locatable as a guide between oppositely traveled ingress and egress paths associated with an amusement park ride, placing the first and second terminals to each serve a different one of the ingress and egress paths.

10. The bank of dual access ride lockers of claim 9, wherein:

said first and second terminals are kiosks located, respectively, at said ingress and egress paths.

* * * * *